US005377729A

United States Patent [19]

Reep

[11] Patent Number: 5,377,729

[45] Date of Patent: Jan. 3, 1995

[54] CHECK VALVE DEVICE FOR A FUEL PUMP NOZZLE

[76] Inventor: Alan J. Reep, Box 111, Stanley, N. Dak. 58784

[21] Appl. No.: 165,198

[22] Filed: Dec. 13, 1993

[51] Int. Cl.[6] ..... B67D 5/00

[52] U.S. Cl. ..... 141/392; 141/206; 222/108

[58] Field of Search ..... 141/206–211, 141/115, 311 A, 214, 392; 222/108, 110

[56] References Cited

U.S. PATENT DOCUMENTS

| | | | |
|---|---|---|---|
| 2,401,124 | 5/1946 | Walker et al. | 141/115 X |
| 2,622,782 | 12/1952 | Giger | 141/209 |
| 2,842,160 | 7/1958 | Rekettye | 222/108 X |
| 3,075,563 | 1/1963 | Botkin | 141/209 |
| 3,085,600 | 4/1963 | Briede | 141/209 |
| 4,213,488 | 7/1980 | Pyle | 141/207 X |
| 4,343,336 | 8/1982 | Trygg | 141/206 X |

FOREIGN PATENT DOCUMENTS

| | | | |
|---|---|---|---|
| 0240691 | 5/1960 | Australia | 141/206 |
| 0228306 | 2/1925 | United Kingdom | 222/108 |
| 0266960 | 3/1927 | United Kingdom | 141/392 |
| 1027271 | 4/1966 | United Kingdom | 141/214 |

*Primary Examiner*—J. Casimer Jacyna
*Attorney, Agent, or Firm*—David A. Lingbeck

[57] ABSTRACT

This invention relates to a check valve device for a fuel pump nozzle comprising a stopper having a stem slidably extending through a bore of a support member which is securely engaged within the passage of the nozzle near the dispensing end thereof. The stopper has a plug member offset and fixedly attached to the stem to close off the passage of the nozzle with the urging of a spring mounted about the stem between the support member and a stop member which is securely attached about the stem near the opposite end thereof. The check valve device prevents liquid such as gasoline from dripping or escaping out the dispensing end of the nozzle when liquid is not being dispensed through the nozzle.

2 Claims, 2 Drawing Sheets

CHECK VALVE DEVICE FOR A FUEL PUMP NOZZLE

BACKGROUND OF THE INVENTION

This invention relates to a check valve device for a fuel pump nozzle to substantially prevent liquid from coming out of the end of the fuel pump nozzle when the pump is turned off.

Fuel pump nozzles are well known in the art and they typically have shut-off valves disposed farther inside the nozzle near the trigger portion of the nozzle, but do not have a check valve device at the discharge end of the nozzle to substantially prevent liquid remaining in the nozzle after the pump is turned off from coming out of the discharge end of the nozzle as does the present invention.

One known prior art is a TRIGGER LOCK FOR FUEL PUMP NOZZLE, U.S. Pat. No. Des. 326,462.

Another known prior art is a TRIGGER LOCK FOR A FUEL PUMP NOZZLE, U.S. Pat. No. Des. 326,271.

Another known prior art is a FLUID DISPENSING NOZZLE INCLUDING IN LINE FLOW METER AND DATA PROCESSING UNIT, U.S. Pat. No. 5,184,309, which comprises a handle, a modular housing within the handle, a fluid flow passage extending through the housing, a controllable flow control valve disposed in the fluid flow passage, a flow meter to measure the flow of fluid, and an electronic data processing unit in the handle, to indicate the fluid flow through the nozzle.

Another known prior art is a SPILL CONTAINMENT AND FLEX HOSE PROTECTION DEVICE, U.S. Pat. No. 5,099,894, which comprises a gasoline supply tank, a dispenser, and at least one gasoline supply line.

Another known prior art is a FUEL DISPENSING NOZZLE WITH VAPOR-PROOF SEAL, U.S. Pat. No. 5,069,260, which comprises a vapor vent tube extending axially outward from the nozzle and arranged in spaced concentric alignment around the nozzle spout to establish a vapor recovery path, a sealing means moveable along the vapor tube, and a biasing means interconnected with the sealing means to prevent the escape of hydrocarbon vapors into the atmosphere.

Another known prior art is a CAST NOZZLE HAVING IMPROVED LATCH AND SHUT-OFF MECHANISM, U.S. Pat. No. 5,067,533, which comprises a hand guard and a lever and clip on the nozzle which further comprises a spine having a plurality of serrations therealong, and a return spring for biasing the clip out of engagement with the lever.

Another known prior art is a GASOLINE NOZZLE WITH EMERGENCY SHUT-OFF, U.S. Pat. No. 5,004,023, which comprises a nozzle having a breakaway outlet portion and an emergency shut-off mechanism which is actuated by separation of the outlet portion from the nozzle and which includes a valve mechanism.

Another known prior art is a GASOLINE DISPENSING NOZZLE, U.S. Pat. No. 4,354,536, which comprises a nozzle having an entrance pipe, an elongated tube, a pair of toggle bars pivotally mounted within the nozzle, and a coil spring for biasing the toggle bars in opposition to one another.

Another known prior art is an EXTENSION FOR GASOLINE DISPENSING NOZZLE, U.S. Pat. No. Des. 261,674.

None of the prior art discloses or suggests the check valve device for a fuel pump nozzle of the present invention. There is a definite need for the present invention which extends through the dispensing end of the nozzle and which substantially prevents liquid such as is found in the gasoline nozzle after the pump is turned off from dripping out of the nozzle.

SUMMARY OF THE INVENTION

This invention relates to a check valve device for a fuel pump nozzle, which comprises a slidable stopper having an elongated stem being fixedly attached to and extending from a plug member dimensioned to close off the passage through the nozzle, and further comprises a support member shaped to allow liquid such as gasoline to pass, but yet shaped to engage inside of the nozzle near the dispensing end thereof to guide the stem of the stopper. The plug member is biased in a closed position over the dispensing end of the nozzle by a spring which is compressionably mounted about the stem between a stop member which is securely mounted about a groove near an end of the stem and the support member to urge the plug member into engagement with the dispensing end of the nozzle. The plug member is urged outward out of engagement with the dispensing end of the nozzle when a stream of liquid is released through the passage in the nozzle by the trigger on the nozzle when the pump is activated. The stream of liquid must have a great enough pressure to compress the spring and slide the plug member out of the dispensing end of the nozzle. The plug member slides back into the dispensing end of the nozzle to close off the passage when the pressure from the stream of liquid is reduced below the pressure effected from the spring.

It is an object of the present invention to provide a check valve device for a fuel pump nozzle which is easy to install in existing fuel pump nozzles anywhere to shut off the passage in the nozzle after the pump is deactivated so that liquid or gasoline doesn't drip out of the nozzle.

Another object of the present invention is to provide a check valve device for a fuel pump nozzle which substantially minimizes or prevents gasoline or other liquids from dripping onto clothes and/or hands of the user as the user removes the nozzle from the pump to begin dispensing gasoline into the tank of a vehicle since the dispensing end of the nozzle is immediately closed when a stream of liquid or gasoline is not being dispensed through the passage of the nozzle.

Also, another object of the present invention is to provide a check valve device for a fuel pump nozzle which substantially reduces the dripping of gasoline onto the ground and endangering the underground water supply by closing off the nozzle so that any excess of gasoline remaining in the passage of the nozzle cannot escape or drip out of the nozzle once the pump is deactivated or gasoline is not being dispensed through the passage of the nozzle.

Yet, another object of the present invention is to provide a check valve device for a fuel pump nozzle which substantially closes off the passage in the nozzle to save and conserve any gasoline remaining in the passage after the pump is deactivated.

Further objects and advantages of the present invention will become apparent as the description proceeds and when taken in conjunction with the accompanying drawings wherein:

DETAILED DESCRIPTION OF THE INVENTION

Figure 1:
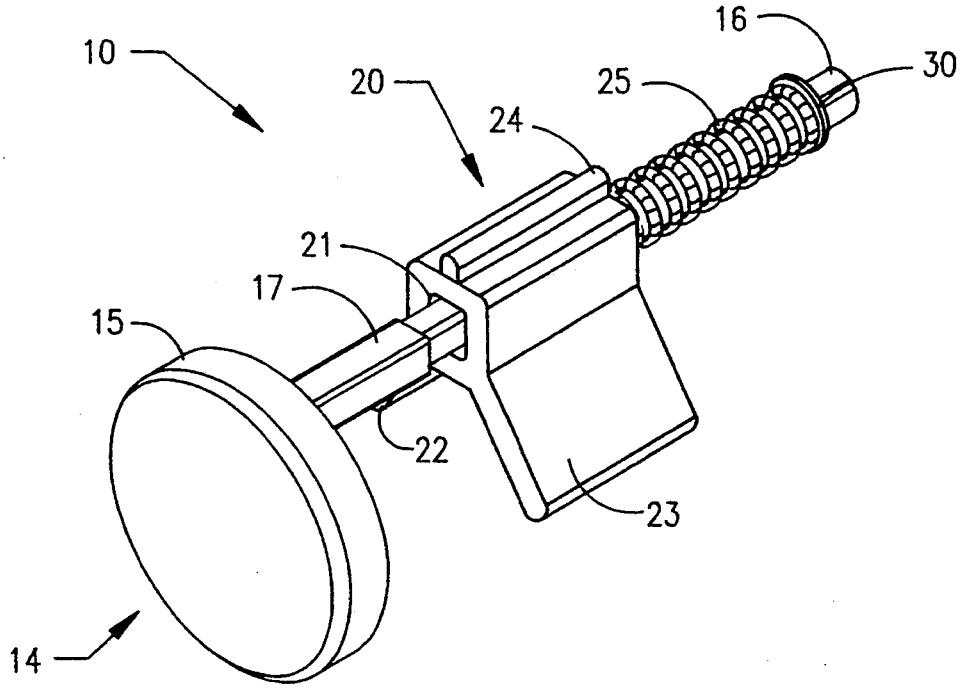
FIG. 1 is a perspective view of the assembled check valve device showing the stopper and elongated stem extending through the support member and through a spring which is held about the stem by a stop member about an end of the stem.

Referring to the drawings in FIGS. 1 through 4, the check valve device 10 for a fuel pump nozzle 40 comprises a stopper 14 preferably made of a chemical resistant material and having an elongated stem 16 offset on and fixedly attached to and extending from a plug member 15 which is dimensioned to close off the dispensing end 42 of a fuel pump nozzle 40; a support member 20 preferably made of a flexible chemically resistant material and engaged in the passage 45 of the nozzle 40 near the dispensing end 42 thereof to guide and hold the stopper 14 and shaped to allow a stream of liquid to pass out of the nozzle 40 and further having a bore 21 through which the stem 16 of the stopper 14 slidably extends to substantially prevent the stem 16 from turning about its longitudinal axis; a stop member 30 attached about an end of the stem; and a spring 25 mounted about the stem 16 in between the stop member 30 and the support member 20 to bias the plug member 15 to close off the passage 45 at the dispensing end 42 of the nozzle 40 when a stream of liquid is not being dispensed through the passage 45 of the nozzle 40.

Figure 2:
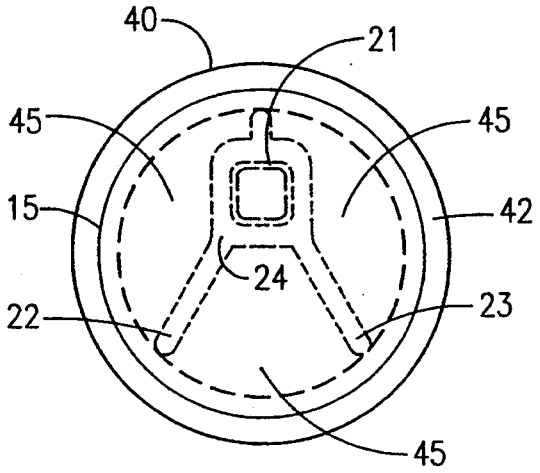
FIG. 2 is a front end view of a nozzle showing the generally inverted V-shaped support member engaged inside the passage of the nozzle.
Figure 3:
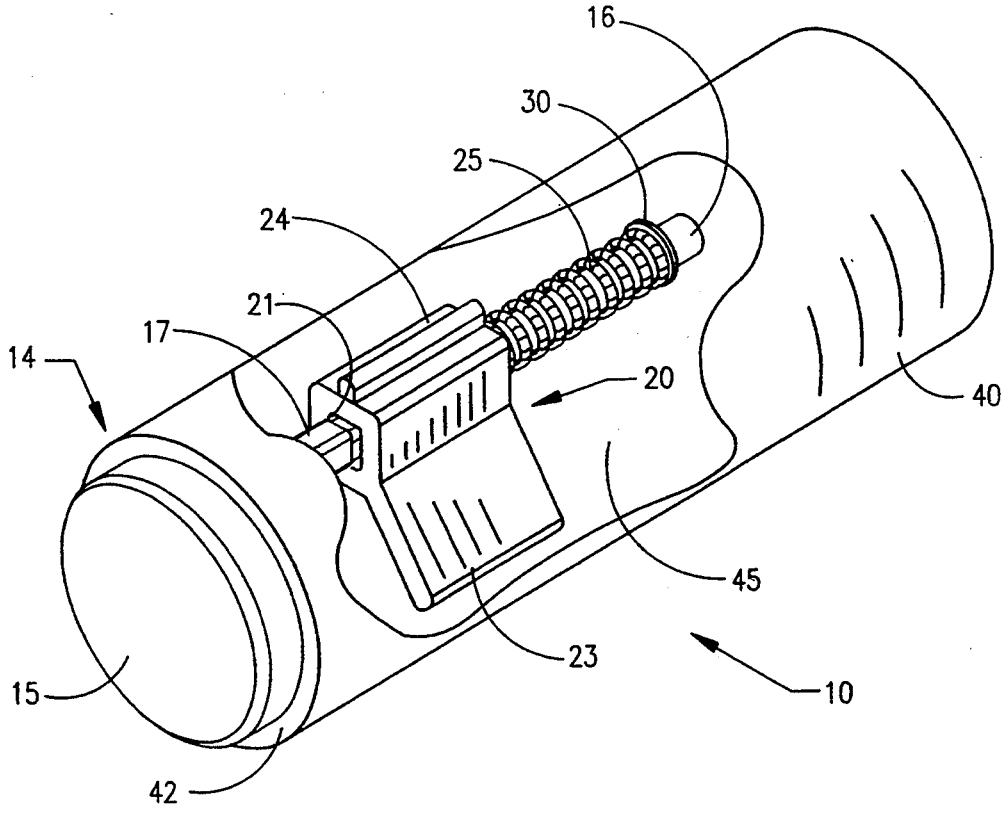
FIG. 3 is perspective view of a portion of a nozzle cutaway showing the check valve device for a fuel pump nozzle disposed inside the nozzle.
Figure 4:
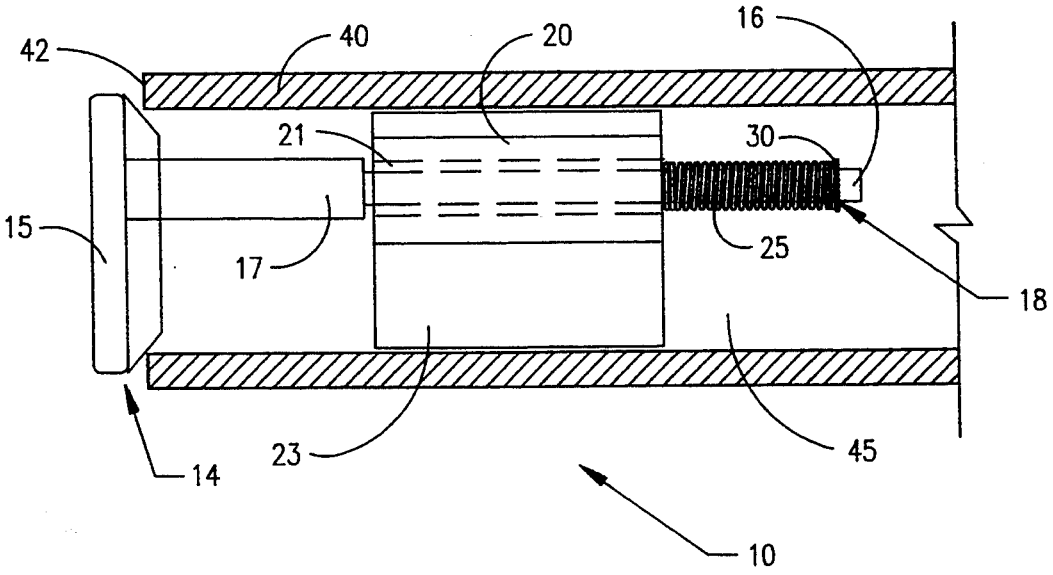
FIG. 4 is a side view in cross section of a portion of a nozzle showing the check valve device for a fuel pump nozzle disposed within the nozzle for slidable movement therein.

As illustrated in FIG. 1, the stem 16 of the stopper 14 essentially has a generally rectangular cross section to substantially prevent the stem 16 from rotating about its longitudinal axis within the bore 21 of the support member 20, which also has essentially a rectangular cross section and which is dimensioned to receive the stem 16 and to substantially prevent the stem 16 from turning within the bore 21. Further, the stem 16 has an expanded portion 17 near to where the plug member 15 is fixedly attached to substantially limit the sliding of the stem 16 within the bore 21 of the support member 20 which, as illustrated in FIG. 2, has two extension member 22 & 23 spaced apart and integrally formed to the body 24 through which the bore 21 extends and slanting downwardly away from one another in essentially an inverted V-shaped fashion. The extension member 22 & 23 and the top of the rectangular cross section securely engage the wall of the passage 45 of the nozzle 40 to substantially hold the support member 20 within the passage 45 of the nozzle 40.

As illustrated in FIGS. 1, 2, 3, and 4, the clip-like stop member 30 is clipped or securely mounted in a groove 18 near the end of the stem 16 opposite the end attached to the plug member 15. The spring 25 is mount about the stem 16 between the support member 20 and the stop member 30 to bias the plug member 15 to close over the dispensing end 42 of the nozzle 40 to prevent liquid such as gasoline from dripping or escaping out of the passage 45 when the fuel pump (not shown) is not activated. The spring 25 urges the stop member 30 away from the support member 20 which urges the stem 16 inward inside the passage 45 of the nozzle 40 so that the plug member 15 engages the dispensing end 42 of the nozzle 40 to substantially close the passage 45 so that liquid remaining inside the passage 45 after the fuel pump (not shown) is turned off does not drip or escape out of the nozzle 40.

In operation, the plug member 15 is urgingly seated in the dispensing end 42 of the nozzle 40 when a stream of liquid is not being dispensed through the nozzle 40. But when the fuel pump (not shown) is activated to dispense liquid such as gasoline through the passage 45 of the nozzle 40, the pressure from the stream of gasoline urges the plug member 15 out of engagement with the dispensing end 42 of the nozzle 40 to allow the liquid to pass out the nozzle 40. The pressure from the stream of liquid is greater than the force exerted by the spring 25 on the stop member 30 to slide the stem 16 within the bore 21 outwardly in relation to the nozzle 40. Once the fuel pump (not shown) is deactivated to stop the flow of liquid through the nozzle 40, the pressure from the stream of liquid also stops allowing the spring 25 to urge the stem 16 to slide within the bore 21 inwardly in relation to the nozzle 40 to seat the plug member 15 into the dispensing end 42 of the nozzle 40 to close the passage 45 so that any liquid remaining in the passage 45 of the nozzle 40 cannot drip or escape therefrom. The spring 25 being mounted against one end of the support member 20 and against the stop member 30 forces or urges the stop member 30 which is securely attached about the stem 16 inwardly in relation to the nozzle 40 causing the stem 16 to slide within the bore 21 inwardly to seat the plug member 15 which is dimensioned to close off the passage 45 of the nozzle 40 in the dispensing end 42 of the nozzle 40.

Various changes and departures may be made to the invention without departing from the spirit and scope thereof. Accordingly, it is not intended that the invention be limited solely to that specifically described in the specification or as illustrated in the drawings but as set forth in the claims.

What is claimed is:

1. A check valve device for a fuel pump nozzle comprising:

a support member having a bore therethrough and being engageable in a passage of said nozzle near a dispensing end thereof; a stopper which comprises a plug member and an elongate stem which is fixedly attached to said plug member which is biasedly adapted to seat in said dispensing end of said nozzle to substantially close a passage through said nozzle and which retractably slides out said dispensing end, effected by flow liquid dispensed through said nozzle, said stem being adapted for sliding and not rotating in said bore, said stem having an expanded portion to restrict sliding of said stem in said bore and to space said plug member from said support member;

a spring mounted about said stem to bias said plug member to close said passage to prevent liquid in said nozzle from leaking therefrom; and a stop member removeably fastened about said stem to provide an abutment against which said spring engages for urging said plug member to seat into said dispensing end of said nozzle.

2. A check valve device for a fuel pump nozzle comprising:

a support member having a bore extending therethrough and being engageable in a passage of said nozzle near a dispensing end thereof and further having a pair of extension members integrally extending therefrom for removeably engaging in said passage to substantially hold said support member therein, said extension members being spaced apart to allow liquid being dispensed to pass by said support member;

a stopper which comprises a plug member and an elongate stem which is fixedly attached to said plug member at a point offset from the center of the plug member which is biasedly adapted to seat in said dispensing end of said nozzle to substantially close a passage through said nozzle and which retractably slides out said dispensing end, effected by flow of liquid being dispensed through said nozzle;

a spring mounted about said stem to bias said plug member to close said passage to prevent liquid in said nozzle from leaking therefrom: and a stop member removeably fastened about said stem to provide an abutment against which said spring engages for urging said plug member to seat into said dispensing end of said nozzle.

* * * * *